US005784916A

United States Patent [19]

Matsuoka

[11] Patent Number: 5,784,916

[45] Date of Patent: Jul. 28, 1998

[54] THIN SHEET FORMING DIE ASSEMBLY INCLUDING A LOWER DIE HAVING PLURAL PARALLEL ROTATING CYLINDRICAL MEMBERS

[75] Inventor: Mitsuo Matsuoka, Hirakata, Japan

[73] Assignee: Umix Co., Ltd., Osaka, Japan

[21] Appl. No.: 795,806

[22] Filed: Feb. 5, 1997

[51] Int. Cl.[6] ..... B21D 5/04

[52] U.S. Cl. ..... 72/313; 72/319; 72/387; 72/452.9

[58] Field of Search ..... 72/312, 313, 314, 72/315, 319, 386, 387, 388

[56] References Cited

U.S. PATENT DOCUMENTS

| | | | |
|---|---|---|---|
| 4,365,500 | 12/1982 | Klukow | 72/319 |
| 4,535,619 | 8/1985 | Gargrave | 72/313 |
| 4,558,582 | 12/1985 | Meinig | 72/387 |
| 4,875,356 | 10/1989 | Boardman et al. | 72/319 |
| 5,347,838 | 9/1994 | Matsuoka | 72/313 |

FOREIGN PATENT DOCUMENTS

| | | | |
|---|---|---|---|
| 0197318 | 11/1984 | Japan | 72/313 |
| 63-41652 | 8/1988 | Japan . | |

*Primary Examiner*—David Jones

*Attorney, Agent, or Firm*—Birch, Stewart, Kolasch & Birch, LLP

[57] ABSTRACT

A die assembly includes a forming portion to form a negative angle portion when an upper die is lowered in a straight line to abut a lower die. A cylindrical rotating cam with a groove formed therein in the axial direction is rotatably mounted in the lower die. A negative angle forming portion is formed in the groove edge portion of the rotating cam. A slide cam with a negative angle forming portion is mounted on the second upper die in such a manner to be opposed to the rotating cam. An automatic return device is provided on the lower die for rotating and retracting the rotating cam to enable the removal of the workpiece from the lower die after the forming process is complete. The rotating cam includes a plurality of rotating cam members, the rotation axis positions of which differ and are parallel to one another.

17 Claims, 10 Drawing Sheets

THIN SHEET FORMING DIE ASSEMBLY INCLUDING A LOWER DIE HAVING PLURAL PARALLEL ROTATING CYLINDRICAL MEMBERS

BACKGROUND OF THE INVENTION

1. Field of the Invention

The invention relates to thin sheet forming dies.

2. Description of the Prior Art

Negative angle forming of thin sheets such as sheet metal or plastics is generally performed using a slide cam.

Negative angle forming referred to herein means such forming which produces a formed portion that enters a lower die from a working locus of an upper die when a workpiece placed on the lower die is formed by lowering the upper die in the vertical direction for abutting against the lower die.

In the conventional negative angle forming of thin sheet products, the workpiece is placed on the lower die and the upper die descends downwards in the vertical direction to drive a driven cam of the lower die by a driving cam of the upper die, and the workpiece is processed from the lateral direction. When processing is complete and the upper die ascends, the driven cam is retracted by springs to its original position.

In this case, the forming portion of the driven cam which slides in from a position laterally outward from the workpiece and forms the workpiece is formed with an integrated profile identical to that of the workpiece. However, the forming portion of the lower die to be loaded with the workpiece must be designed to separate and retract the negative angle forming portion of the lower die, or the rear portion forming the negative angle is deleted and the work must be moved forward to enable the removal of the workpiece. When the negative angle is small, no serious problems occur. However, when the negative angle is large, or the work has a slender frame-like cross section with grooves, for example, parts such as an automobile front pillar outer, due to the narrow groove width of the workpiece, not only is the profile unable to be clearly formed at the forming portion of the driven cam when the negative angle forming portion of the lower die is divided or deleted, but also the diminished strength of the lower die made it impossible to carry out the negative angle forming process.

In negative angle forming using the slide cam, the driven cam is slid over a considerably long straight distance. Thus, it is not always easy to repeatedly slide the driven cam exactly to a specified position, and it is difficult to produce products with stable quality. In addition, there are cases in which distortion or bending is generated in products, and the products must be touched up. However, it is practically impossible to touch up products composing the automobile outer plate portions such as side panels, front fenders, roofs, bonnets, trunk lids, door panels, or front pillar outers, because they have three-dimensional curved surfaces and profiles. In the case of automobile sheet metal assembly, if any distortion or bending is generated in the products, it is difficult to combine such products with other parts, and it is not possible to provide a high-quality automobile sheet metal structure or to maintain a specified product accuracy of thin-plate formed products.

When the slide cam is used, a large driven cam and heel must be mounted on the side portion of the lower die where the workpiece is loaded, requiring a large lower-die area, increasing the die weight, and resulting in expensive dies.

Therefore, in order to solve the above problems, a forming die and a method of forming thin sheets in which the linear upward and downward motion of a press is converted into rotary motion has been proposed by the present applicant in Japanese Patent Publication No. Sho 63-41652.

Referring now to FIGS. 6–10, the forming dies of the prior art will be described in further detail.

FIGS. 6A and 6B show left and right schematic perspective views, respectively, of a complete front pillar outer, an automobile sheet metal part formed by the forming dies. This front pillar outer constitutes part of the front door frame, also part of the front windshield frame, and in addition part of the frame supporting the roof panel. Therefore, it has a number of connections with many parts, and this is a product for which severe product accuracy is required. If the required accuracy is not satisfied, it is not possible to provide a sheet metal car body with good quality.

Because the front pillar outer composes the outer plate portion of the automobile, it has three-dimensional curved surfaces and profiles.

The portion with the negative angle formed by this forming die is designated with the letter F, whose cross section is shown as the workpiece W in FIG. 10.

That is, after the negative angle is formed, the workpiece W achieves the condition shown in FIG. 10 from the condition shown in FIG. 7. The press-working process includes drawing which takes place first, then, peripheral trimming is performed such that the workpiece achieves the condition shown in FIG. 7 and this forming process as described herein is performed as the succeeding third process.

With respect to the lower die 100, a cylindrical rotating cam 102 formed with an axial groove 101 is rotatably mounted to the lower die body 103. The lower die body 103 is securely fixed to the lower substrate 121 with a bolt 122. The top surface of the lower die body 103 is formed in a shape that can receive the workpiece W, and a negative angle forming portion 104 is formed at the edge portion of the axial groove 101 of the rotating cam 102 nearest to the top surface of the lower die body 103. An automatic return device 105 which rotates and retracts the rotating cam 102 is embedded in the lower die body 103 so that the workpiece W can be removed from the lower die body 103 after the forming process. In this example, the automatic return device 105 brings a push pin 107 biased by a coil spring 106 in contact with the bottom surface of the tip end of a rolling plate 108 securely fixed to the surface of the axial groove 101 of the rotating cam 102 by a bolt 151 at a location opposite to the negative angle forming portion 104.

For the automatic return device 105, pneumatic devices, hydraulic devices, link mechanisms, cams, or other similar mechanisms may be used, and may be mounted not only to the lower die but also between an upper die 109 and the lower die 100. On the other hand, to the upper die 109, a slide cam 110 is mounted at a position opposite to the rotating cam 102. This slide cam 110 has a negative angle forming portion 112 formed at the bottom end thereof. The slide cam 110 is guided by a guide (not illustrated), and the slide cam 110 is biased in the outward direction of the die by a coil spring 117 compressedly mounted between the slide cam 110 top surface and an inclined guide 154 bottom surface securely fixed to the top substrate 152 with a bolt 153. The slide cam 110 is stopped by a stopping plate 156 securely affixed to the inclined guide 154 with a bolt 155. A pad 157 biased downwards by a coil spring 158 is suspended from the top substrate 152 by a bolt 119, and strongly presses the workpiece W against the lower die body 103 to prevent the workpiece W from moving before the negative angle is formed on the workpiece W.

Next the operation of this prior art forming die will be described.

First of all, as shown in FIG. 7, the upper die 109 is located at the top dead center, and then, the workpiece W is loaded on the lower die body 103 of the lower die 100. At this time, the rotating cam 102 is rolled and retracted by the automatic return device 105.

Then, the upper die 109 begins descending as shown in FIG. 8. First, the bottom surface of the slide cam 110 comes in contact with the rolling plate 108 to rotate the rotating cam 102 clockwise in FIG. 8 without causing the slide cam 110 to interfere with the negative angle forming portion 104 of the rotating cam 102.

As the upper die 109 continues to descend further, the slide cam 110 biased in the outward direction of the die resists against the biasing force of the coil spring 117, moves to the left in the lateral direction by the operation of the cam, enters the state shown in FIG. 9, and the negative-angle forming portion 104 of the rolled rotating cam 102 cooperates with the negative-angle forming portion 112 of the slide cam 110 to form the negative-angle portion on the workpiece W.

After the negative angle portion is formed, the upper die 109 begins rising. The slide cam 110 is biased in the outward direction of the die by the coil spring 117, moves to the right in FIG. 10, and ascends without interfering with the workpiece W with the negative angle portion formed thereon.

On the other hand, the rotating cam 102 rotates to the left in FIG. 10 by the automatic return device 105 because the slide cam 110 ascends, enabling the workpiece W to be removed without interfering with the negative angle forming portion 104 of the rotating cam 102 when the negative-angle formed workpiece W is removed from the lower die body 103.

Thin sheet products with the negative angle formed thereon have been made using the rotating cam described above. As the rotating cam rotates around the rotation axis to process the workpiece W, if the workpiece W is nearly linear and is not greatly curved, the negative angle forming portion can enter one of the cylindrical rotating cams and is able to form the workpiece W with a negative angle. However, if the workpiece W is greatly curved, the workpiece W is unable to completely enter one of the cylindrical rotating cams to form the negative angle portion, and is therefore unable to be processed.

In particular, automobile sheet metal parts including door panels have many curved portions, and in recent years, there are many parts having negative angle portions. From the viewpoint of designs, in addition to conventional curved portions, it is desired to form these negative angle portions in one process without undergoing many processes, whereby the production efficiency is improved.

SUMMARY OF THE INVENTION

This invention relates to a forming die for forming a greatly bent negative angle forming portion on thin sheets with a plurality of parallel rotating cams having rotational axes located at varying positions.

The size of the rotating cam diameter cannot be practically excessively increased from the viewpoint of fabricating dies, and is, for example, about 320 mm. For a greatly bent workpiece, the bent portions are processed by parallel rotating cams with varying positions of the rotation axes. The rotating cams are designed to be displaced vertically and horizontally in accordance with the degree of the bend. Special consideration shall be given to the splitting position of the rotating cams so that the negative angle forming portion does not become excessively acute. If the negative angle forming portion becomes excesively acute, the strength decreases, and it is therefore preferable to prevent the angle from being 30° or less.

Because a plurality of rotating cams according to this invention are arranged in such a manner that the rotation axes become parallel to one another, the end faces do not interfere with each other at the joints of adjoining rotating cams, when rotated.

In addition, a linkage mechanism is mounted to the adjoining rotating cams according to this invention, and the rotating cams can be driven by one automatic return device.

Furthermore, in this invention, a latching plate and a pin are engaged as a linkage mechanism, achieving an extremely simple construction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Referring now to one specific embodiment shown in FIGS. 1–5, this invention will be described in further detail.

Figure 1:
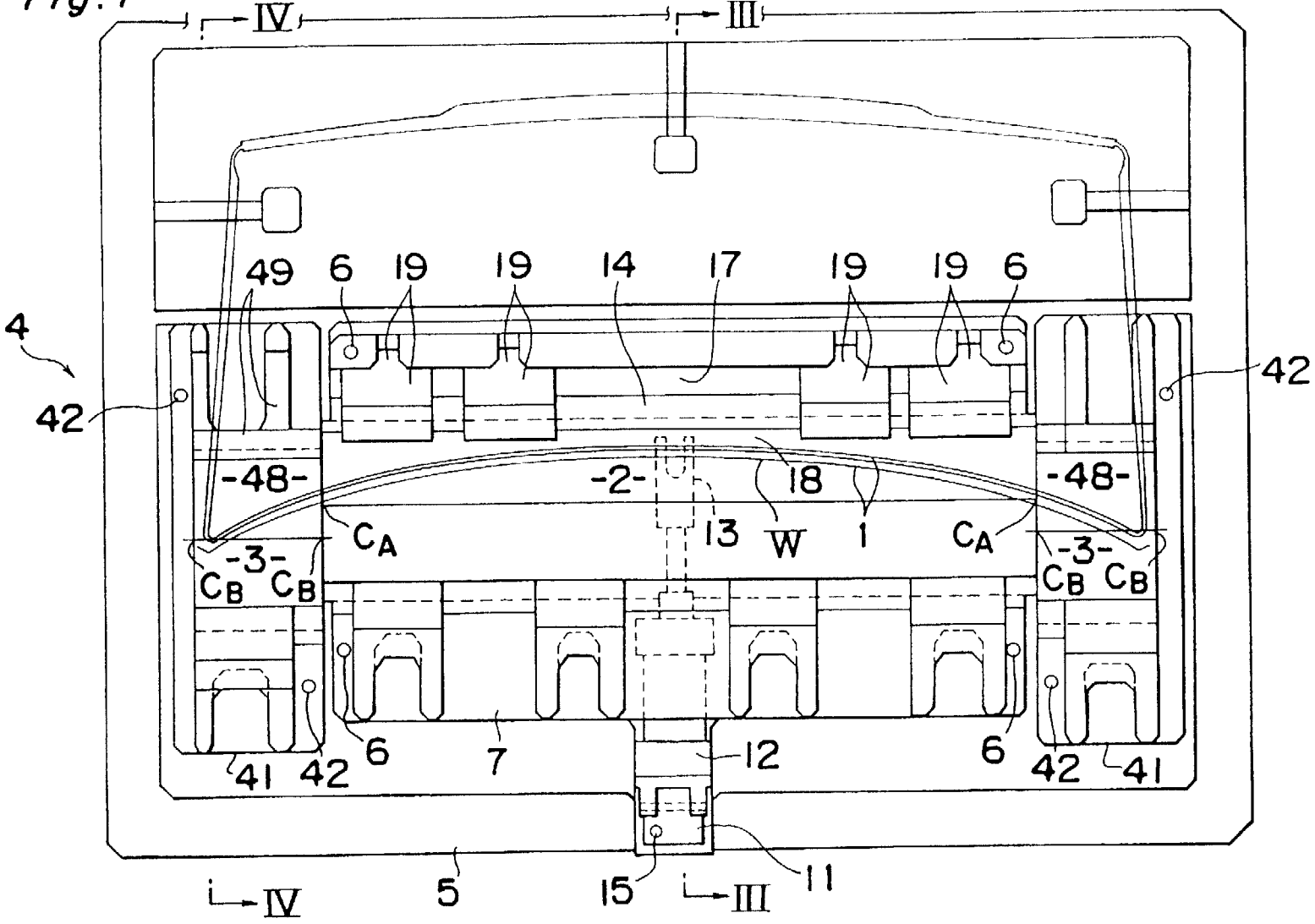
FIG. 1 is a plan view of one specific embodiment according to this invention.
Figure 2A:
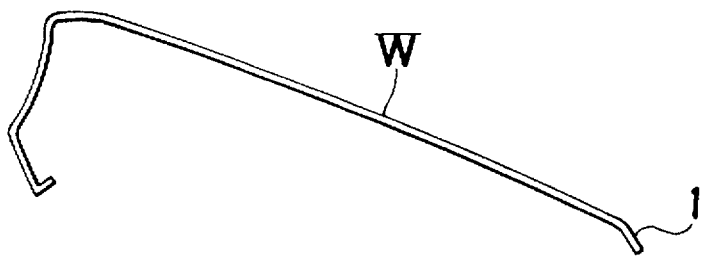
FIGS. 2A and 2B are cross-sectional views of the workpiece W taken on line III—III of FIG. 1 before and after negative-angle forming.
Figure 2B:
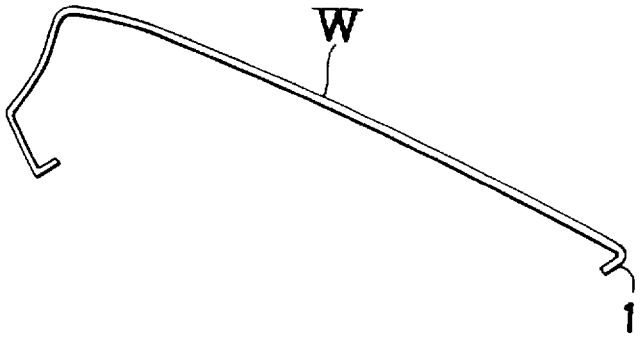

The workpiece W formed by the forming dies according to this invention is an automobile trunk lid outer as shown in FIG. 1. The recessed circular arc curved portion of the front edge portion of the trunk lid outer as shown in plan view is formed with a negative-angle portion.

The processed portion of the workpiece W of the thin sheet forming dies is the front edge portion of the trunk lid outer. As shown in FIG. 1, it is a recessed form as seen from the plan view, and as is clear from FIG. 4, both end portions are located considerably below the center portion and considerably displaced toward the right. If this is processed with an ordinary one piece rotating cam, an extremely large rotating cam is required. Excessively increasing the size is practically impossible in fabricating dies, and about 320 mm in diameter is the maximum. In addition, the flange angle differs at the center portion and both end portions, and there is a case in which the negative-angle forming portion of the rotating cam becomes too acute to maintain the necessary strength. In this invention, the rotating cam is divided into three portions; namely, the center portion and both end portions, and a linkage mechanism is mounted to the rotating cam, so that all the rotating cams can be driven by one slide cam.

On both end portions of the center rotating cam 2 having a rotating axis $C_A$ in FIG. 1, edge portion rotating cams 3 having a rotation axis $C_B$ are arranged. As is clear from FIG. 4, each edge portion rotating cam 3 is displaced downward by an amount H and rightward by an amount L from the center rotating cam 2.

The lower die 4 has a support block 7 fixed to the lower die base 5 with a bolt 6, and rotatably supports the cylindrical center rotating cam 2 in a horizontal slot groove 8 of the support block 7. A groove 14 is formed axially in the rotating cam 2.

In this embodiment, an air cylinder 12 is utilized as an automatic return device for the rotating cam. Needless to say, the automatic return device is not limited to an air cylinder, but a spring, hydraulic equipment, link mechanism, cam or any mechanisms similar to these may be used, and can be mounted not only to the lower die but also to the upper die.

Figure 3:
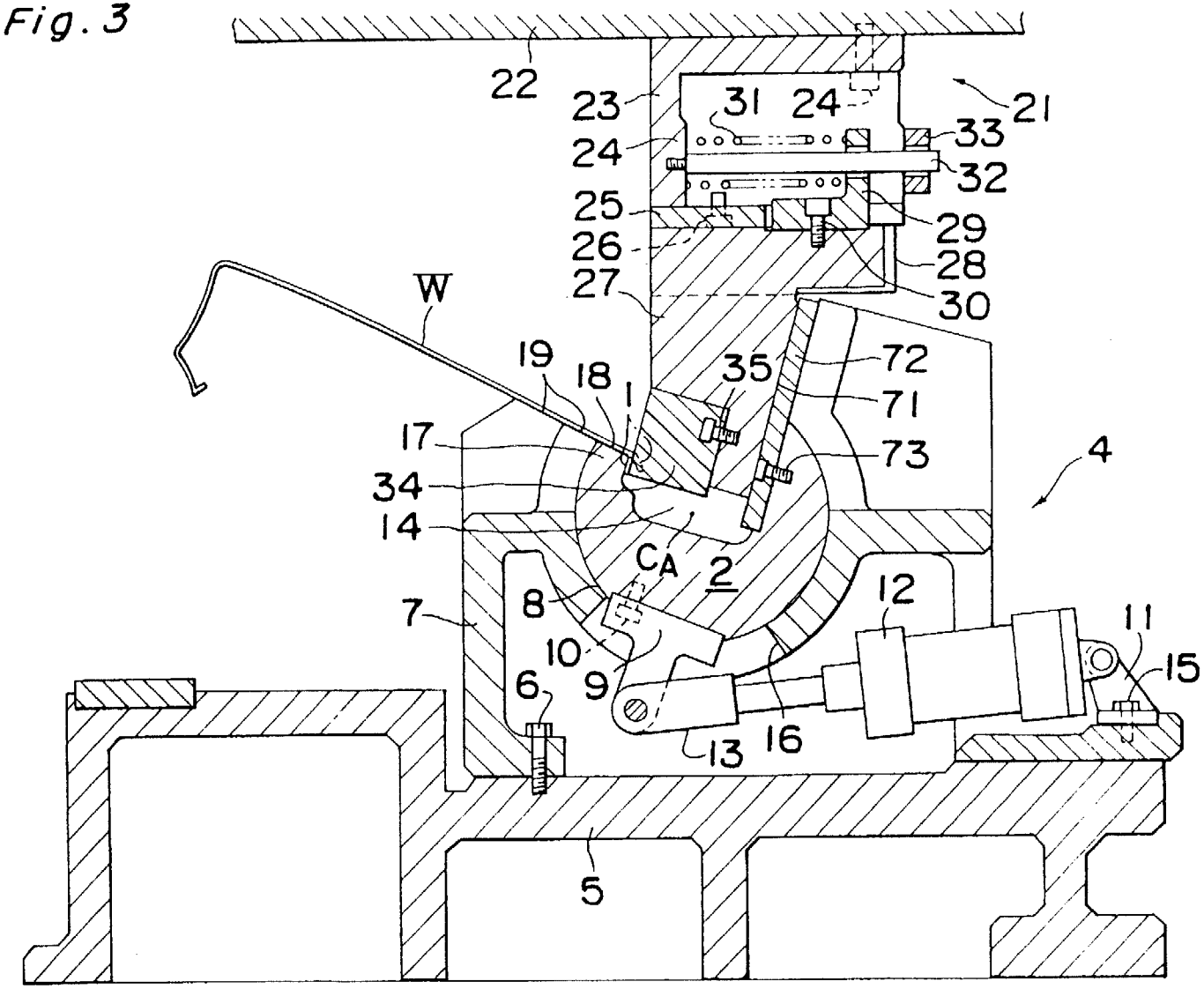
FIG. 3 is a longitudinal cross-sectional view taken on line III—III of FIG. 1.

In FIG. 3, a connecting member 9 is fixed to the bottom surface of the center rotating cam 2 with a bolt 10, and to the tip end of a piston rod 13 of the air cylinder 12 whose base end is pivotally mounted to the bracket 11 fixed to the support block 7 with a bolt 15. The connecting member 9 is pivotally mounted, so that the piston rod 13 may be contracted to return the center rotating cam 2 to its original position. At the bottom portion of the slot groove 8 of the support block 7, a window slot 16 is provided for allowing the connecting member 9 to pass therethrough.

At the edge portion of the groove 14 of the center rotating cam 2, a negative angle forming portion 17 is formed. A rolling plate 72 is fixed to the side opposite to the negative angle forming portion 17 of the groove 14 with a bolt 73. It should be noted that in FIG. 1, the rolling plate 72 is omitted for clarity. The negative angle forming portion 17 of the center rotating cam 2 is located partially within a work support portion 18 having a profile the same as the bottom surface of the workpiece W so that the workpiece W is properly supported. A work loading portion 19 having a profile the same as the bottom surface of the workpiece W is formed slightly outwards in the upper portion of the work support portion 18 of the support block 7.

An upper die 21 has a support block 23 fixed to the lower surface of an upper die base 22 with a bolt 24. A wear plate 25 is fixed to the lower surface of the support block 23 with a bolt 26. A slide cam 27 is held by a guide plate 28 for sliding movement on the lower surface of the wear plate 25. At the portion of the slide cam 27 opposite to the groove 14 of the center rotating cam 2, a negative angle forming portion 34 is fixed with a bolt 35.

On the top surface of the slide cam 27, a support plate 29 is fixed with a bolt 30. Between this support plate 29 and a longitudinal wall 24 of the support block 23, a coil spring 31 is compressedly mounted to bias the slide cam 27 to the outward direction of the die.

The coil spring 31 is mounted around a positioning pin 32 screwed into the longitudinal wall 24, and the tip end of the positioning pin 32 allows a stopping plate 33 fixed to the side surface opposite to the longitudinal wall 24 to pass therethrough. When the upper die 21 rises, the slide cam 27 moves outwards of the die until the support plate 29 comes in contact with the stopping plate 33 by the biasing force of the coil spring 31.

Though it is not illustrated, in order to stably support the workpiece W, a positioning member for the workpiece W is mounted on the lower die 4, and to the upper die 21, as described in the conventional example. A pad for pressing the workpiece W is mounted to the lower die, but since inclusion of these elements would make the illustration complicated and essential points of this invention difficult to understand, the positioning member and the pad are omitted from FIGS. 1, 3 and 4.

Next, referring to FIG. 4, the construction of the die assembly on both edge portions of the workpiece W will be described.

To the lower die base 5, an edge supporting block 41 is fixed with a bolt 42. A cylindrical edge portion rotating cam 3 with a groove 44 formed in the axial direction is rotatably supported in a horizontal slot groove 43 at the top surface center of the edge supporting block 41.

At the peripheral portion of the groove 44 of the edge portion rotating cam 3, a negative angle forming portion 45 is formed. On the side opposite to the negative angle forming portion 45 of the groove 44, a rolling plate 40 is securely fixed with a bolt 47. In FIG. 1, a rolling plate 40 is omitted. The negative angle forming portion 45 of the edge portion rotating cam 3 is formed into a work loading portion 48 having a profile the same as the bottom surface of the workpiece W. A work support portion 49 having a profile the same as the bottom surface of the workpiece W is formed on the supporting block 41 sightly outwards from the top portion linked to the work loading portion 48 of the edge portion rotating cam 3.

Figure 4:
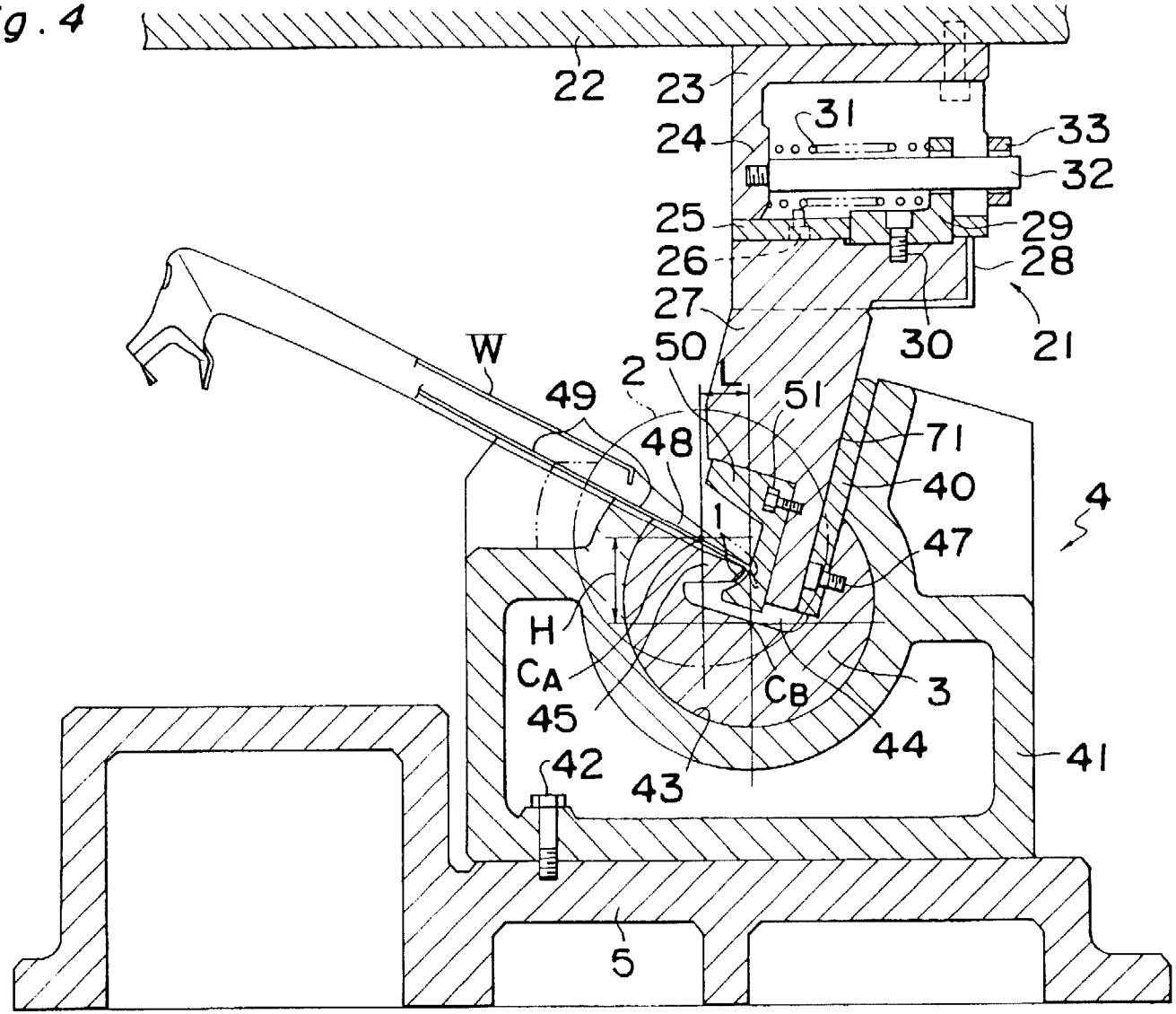
FIG. 4 is a longitudinal cross-sectional view taken on line IV—IV of FIG. 1.

In FIG. 4, like elements of the upper die 21 of FIG. 3 are given like reference characters and they fulfill like functions. At a position opposite to the groove 44 of the edge portion rotating cam 3, a negative angle forming portion 50 is fixed to the slide cam 27 with a bolt 51.

In FIG. 4 and as in FIG. 3, to the lower die 4, a workpiece W positioning member and to the upper die 21, a pad are mounted, respectively, but their illustrations are omitted.

Figure 5A:
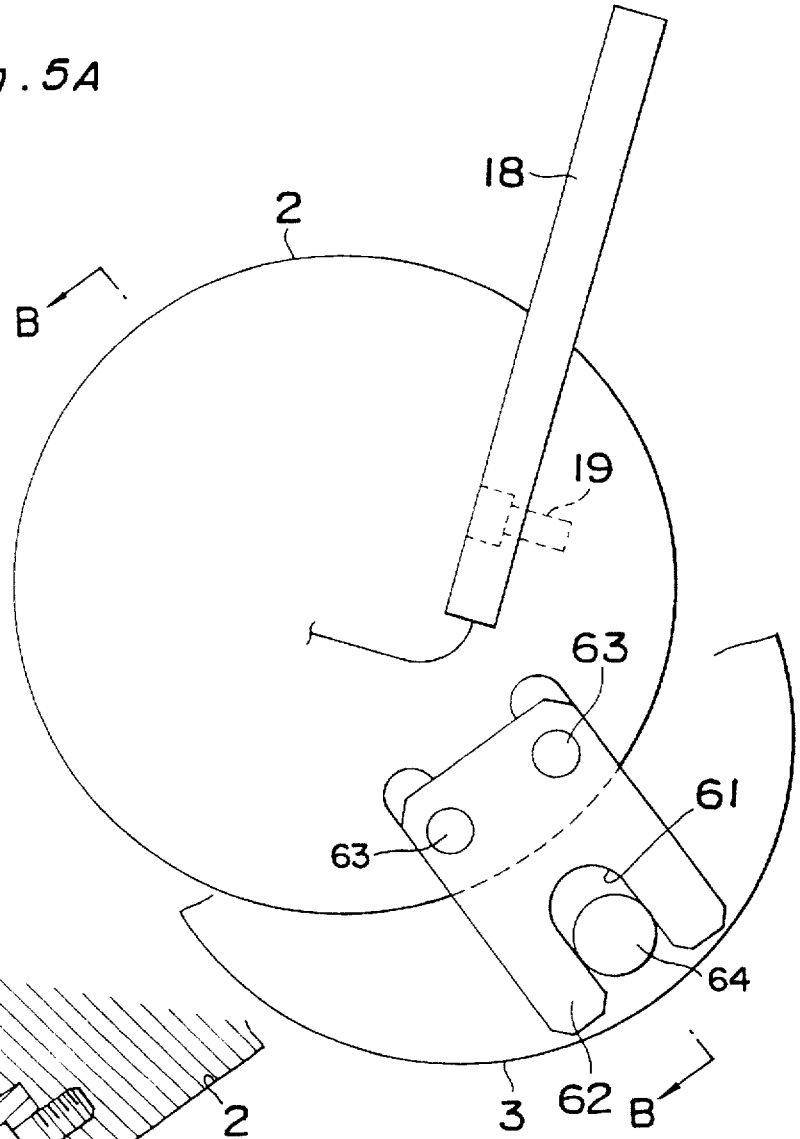
FIGS. 5A and 5B are two views showing a linkage mechanism according to this invention.
Figure 5B:
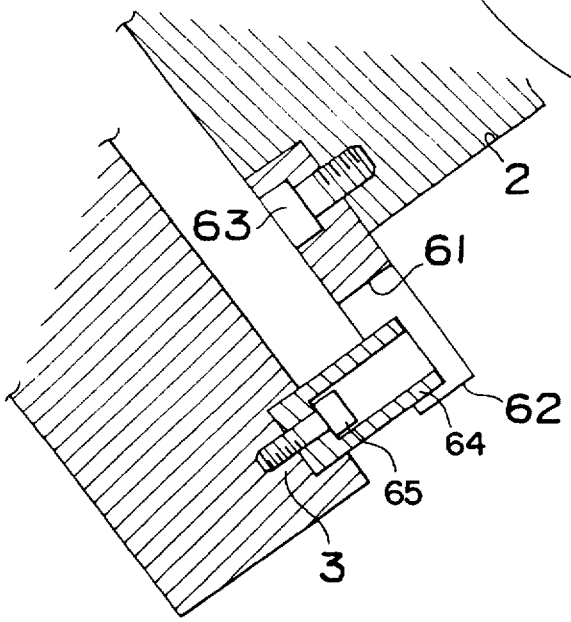
Figure 6A:
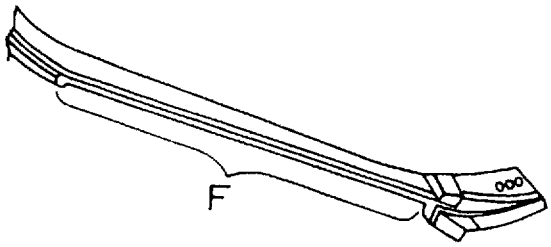
FIGS. 6A and 6B show left and right perspective views, respectively, of the completed front pillar outer of an automobile.
Figure 6B:
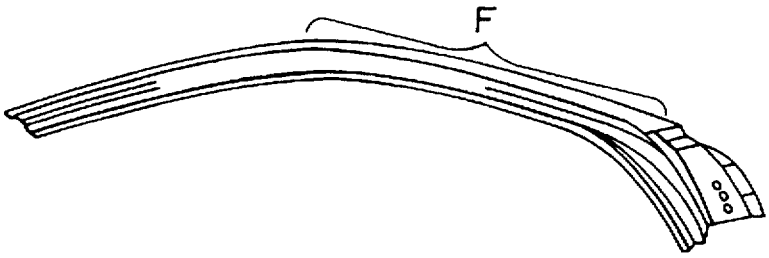

In FIGS. 5A and 5B, there is shown a linkage mechanism for transmitting the rolling force transmitted to the center rotating cam 2 by the air cylinder 12 to the adjoining edge portion rotating cams 3 on both sides of the center rotating cam.

A latching plate 62 with a notched groove 61 formed therein is fixed to the end face of the center rotating cam 2 by bolts 63. A positioning pin 64 is fixed with a bolt 65 to the position of the edge portion rotating cam 3 on the end face opposite to the notched groove 61 of the latching plate 62 on the end face of the center rotating cam 2.

When the center rotating cam 2 is driven with the air cylinder 12, the edge portion rotating cam 3 is simultaneously rotated in the same direction because the pin 65 is engaged with the latching plate 62.

Alternatively, it is possible to drive the edge portion rotating cam with an air cylinder which thereby drives the center rotating cam.

The example described herein includes three rotating cams, but it is also possible to drive four or more rotating cams by one air cylinder with a linkage mechanism interposed therebetween.

Next, description will be made of the operation of the thin sheet forming dies.

Figure 9:
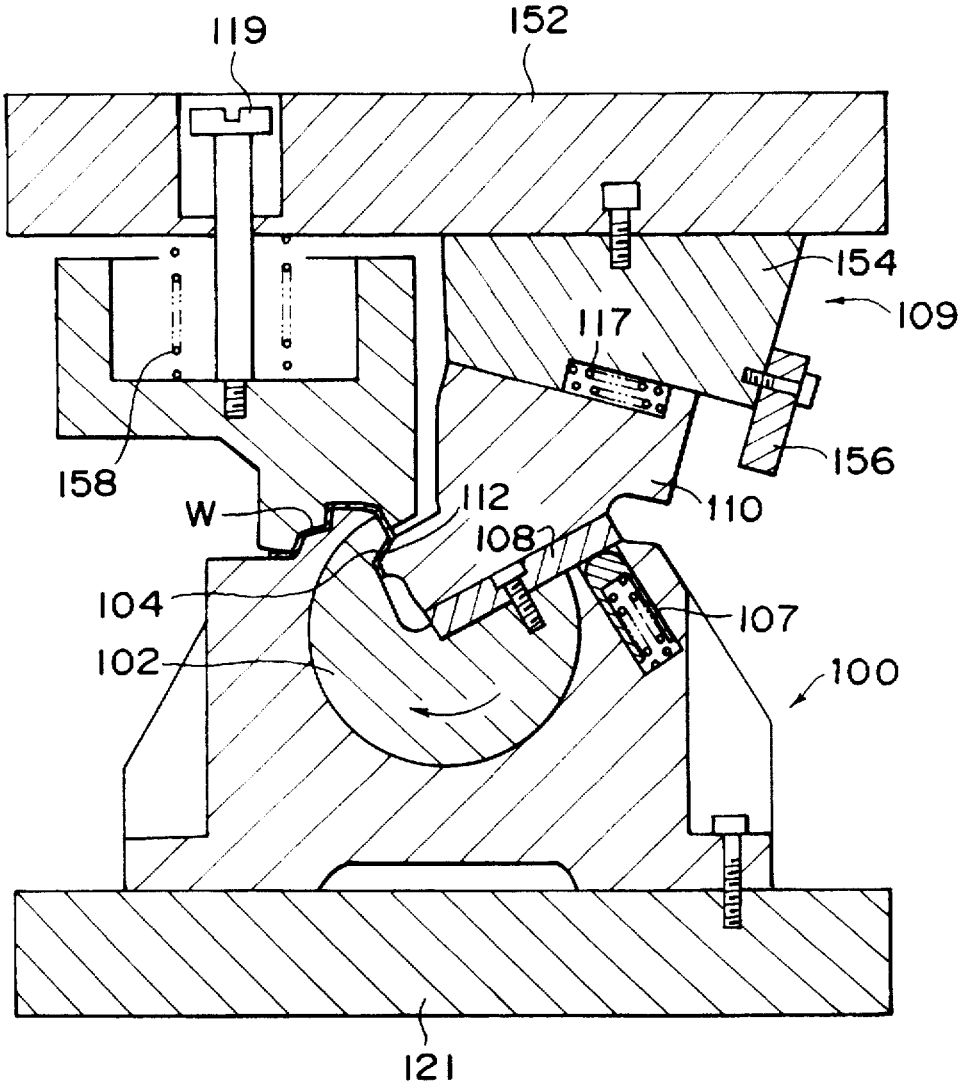
FIG. 9 is a longitudinal cross-sectional view of the die assembly of FIG. 7 in the bottom dead center condition.
Figure 10:
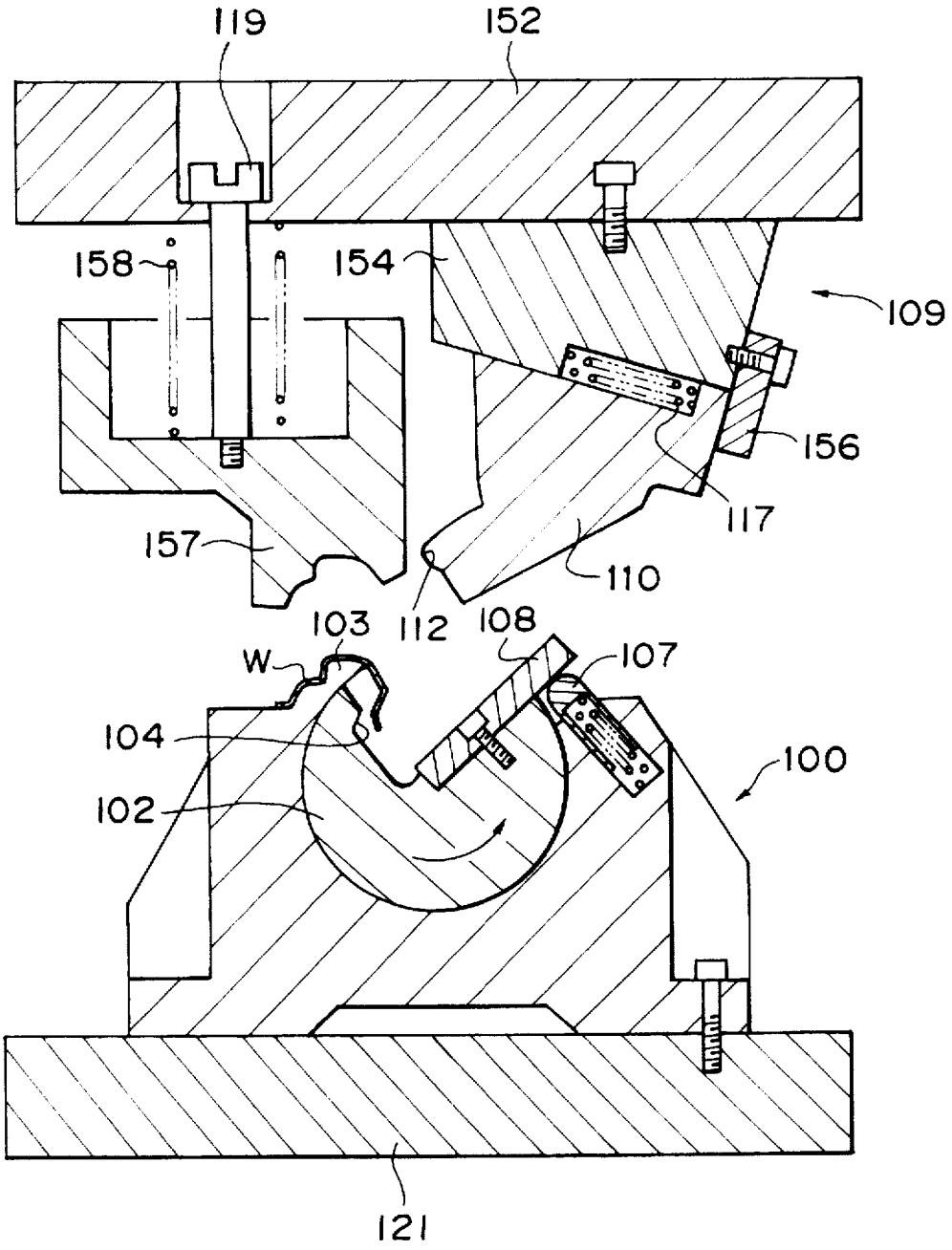
FIG. 10 is a longitudinal cross-sectional view of the die assembly of FIG. 7 showing the workpiece W located on the lower die after the negative-angle forming process is finished.

The condition shown in FIGS. 3 and 4 is the bottom dead center condition and corresponds to FIG. 9 of the conventional example.

Figure 7:
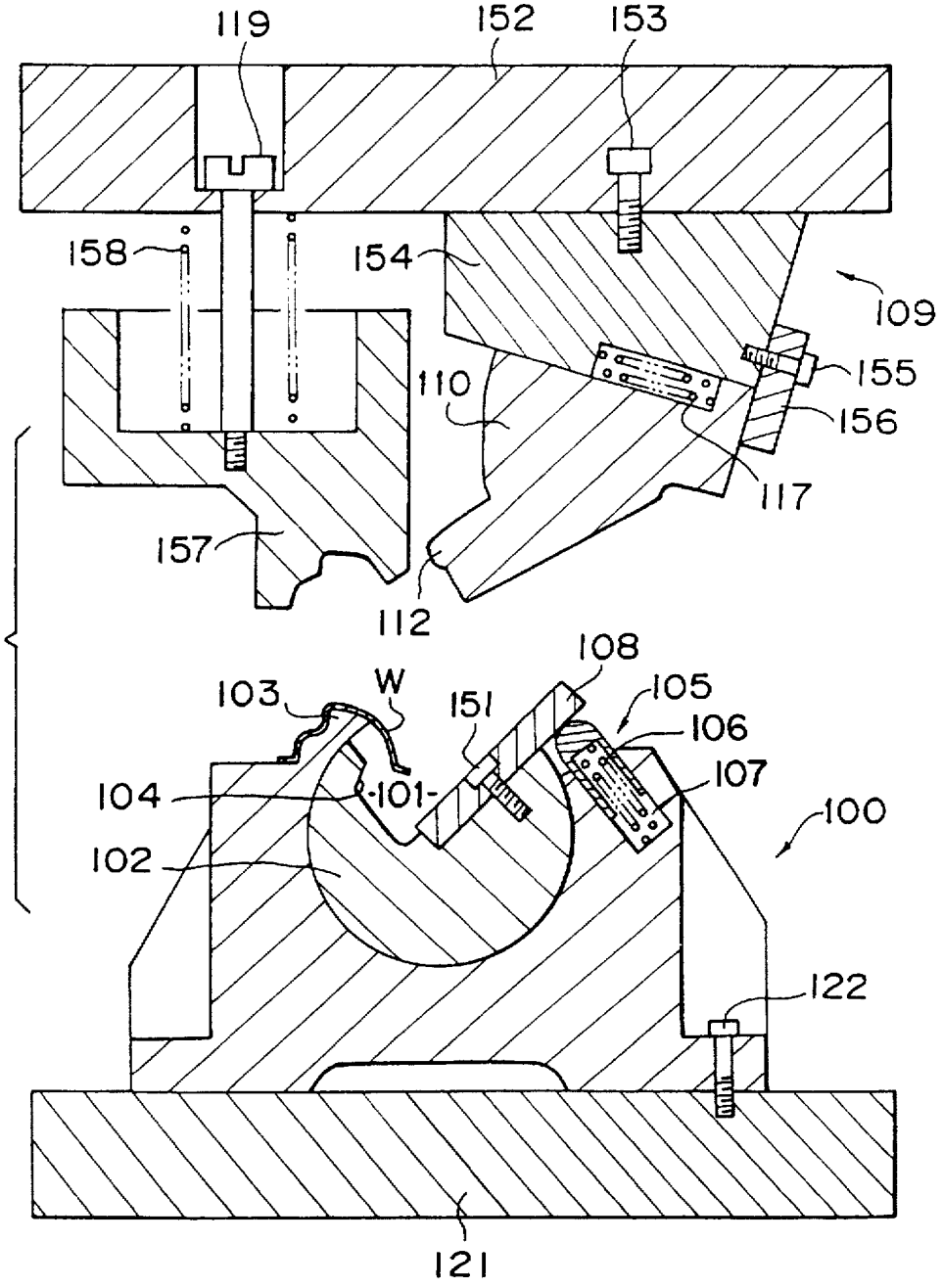
FIG. 7 is a longitudinal cross-sectional view of a prior art die assembly when the upper die is in the top dead center condition and showing the workpiece W before processing.

In this invention, it is not illustrated but as shown in FIG. 7 of the conventional example, the upper die 21 is located at the top dead center when the workpiece W is loaded to the work loading portions 19, 49 of the lower die 4. At this time, the center rotating cam 2 and the edge portion rotating cams 3 are rolled to a retracted position by the air cylinder 12.

Figure 8:
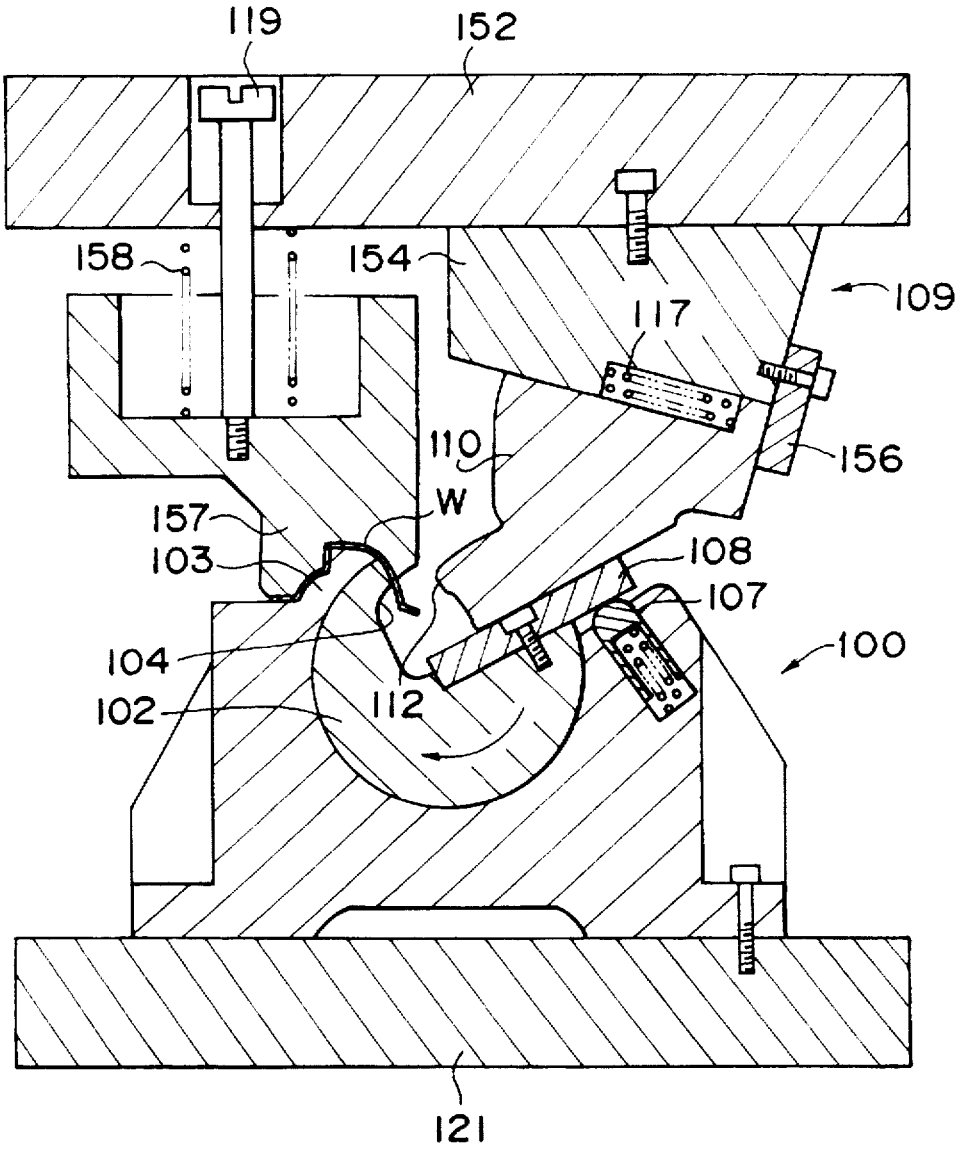
FIG. 8 is a longitudinal cross-sectional view of the die assembly of FIG. 7 which descends to come in contact with the lower die.

Next, in a manner similar to that shown in FIG. 8 of the conventional example, in the upper die 21, the inclined surface 71 of the slide cam 27 comes in contact with the rolling plates 18, 46 without allowing the slide cam 27 to interfere with the negative angle forming portions 17, 45 of the center rotating cam 2 and edge portion rotating cams 3. This causes the center rotating cam 2 and the edge portion rotating cams 3 to rotate clockwise.

As the upper die 21 further continues to descend, the slide cam 27 biased in the outward direction of the die assembly against the biasing force of the coil spring 31 moves to the left in the lateral direction by the action of the cam. As shown in FIGS. 3 and 4, the negative angle forming portions 17, 45 of the center rotating cam 2 and the edge portion rotating cams 3 cooperate with the negative angle forming portions 34 and 50 of the slide cam 27 to form the workpiece W with a negative angle portion.

After the negative angle portion is formed, the upper die 21 begins to ascend. The slide cam 27 is biased in the outward direction of the die assembly by the coil spring 31, and moves to the right and ascends without interfering with the negative-angle formed workpiece W.

On the other hand, when the slide cam 27 ascends and the air cylinder 12 contracts the piston rod 13, the center rotating cam 2 and the edge portion rotating cams 3 rotate in the right direction to enable the removal of the workpiece W without interfering with the negative angle forming portions 17, 45 of the center rotating cam 2 and the edge portion rotating cams 3, when the negative-angle formed workpiece W is removed from the lower die 41.

In this invention, in order to take out the workpiece W without allowing the workpiece W to interfere with the lower die, rolling the center rotating cam 2 by the air cylinder 12 rolls and retracts the separate edge portion rotating cam 3 positioned on both sides. It is possible to operate a plurality of rotating cams by one air cylinder with a linkage mechanism interposed therebetween.

Because an excessively bent negative angle forming section is divided into a plurality of portions, it is possible to prevent the negative-angle forming portions of the rotating cams from being excessively acute, and the rotating cams may therefore remain strong.

In addition, because in this invention, a plurality of rotating cams are arranged with their rotation axes parallel to one another, their end faces do not interfere with one another at the joints of adjoining rotating cams when the rotating cams rotate.

In addition, a linkage mechanism may be provided on the adjoining rotating cams according to this invention so that rotating cams can be driven by one automatic return device. The linkage mechanism may include a latching plate and a pin, achieving an extremely simple construction.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A pressing apparatus comprising a lower die having a supporting portion for supporting a metal sheet material to be worked and an upper die movable in a path downwardly and linearly with respect to said lower die to abut on the material to be worked, so as to shape the material to be worked, said pressing apparatus further comprising:

at least one cylindrical member having an outer surface and end faces and being rotatably disposed in said lower die adjacent said supporting portion, said cylindrical member having a groove opening to said outer surface and along its axial extent and a recess-forming portion formed at an edge portion of said groove near to said supporting portion and stepped inside from said path of said upper die;

a slide cam having a recess-forming portion and slidably arranged on said upper die for confronting said cylindrical member; and an automatic return element, provided in said lower die, for rotationally returning said cylindrical member to a starting position at which said material, after being shaped, can be taken out from said lower die, wherein said material to be worked is placed on said supporting portion of said lower die and is shaped by rotating said recess-forming portion of said cylindrical member by sliding movement of said recess-forming portion of said slide cam, and thereafter said cylindrical member is rotationally returned to said starting position by said automatic return element so that the worked material can be taken out from said lower die, and wherein said at least one cylindrical member comprises a plurality of cylindrical members, the rotational axes of which differ and are parallel to one another, and a linkage mechanism mounted to said plurality of cylindrical members such that the plurality of cylindrical members are each returned to said starting position by said automatic return element.

2. The pressing apparatus according to claim 1, wherein the linkage mechanism has a latching plate equipped on an end face of one of the cylindrical members, and a pin on an end face of an adjacent one of the cylindrical members for engaging the latching plate.

3. A pressing apparatus comprising:

an upper die and a lower die, said upper die and said lower die being movable relative to one another;

said lower die including a workpiece support, said lower die further including a plurality of cylindrical members rotatable with respect to said workpiece support about spaced-apart parallel axes of rotation, said cylindrical members having an axially extending groove therein including first forming portions; and said upper die including a slide cam slidable thereon, said slide cam having second forming portions thereon at locations opposed to said first forming portions, whereby displacement of said upper die toward said lower die causes said slide cam and said second forming portions to move toward said first forming portions of said cylindrical members to thereby shape a portion of a workpiece which is located between said first and second forming portions.

4. The pressing apparatus according to claim 3, wherein each of said cylindrical members further includes a slide cam engaging member extending outwardly therefrom which is engagable by said slide cam to cause said cylindrical members to rotate.

5. The pressing apparatus according to claim 3, further including a return device for returning the cylindrical members to a position where the workpiece may be removed from the lower die.

6. The pressing apparatus according to claim 5, wherein said return device comprises an air cylinder.

7. The pressing apparatus according to claim 6, wherein said air cylinder includes a rod having a distal portion pivotally attached to a connecting member extending from one of said cylindrical members.

8. The pressing apparatus according to claim 7, wherein said connecting member extends through an opening provided in a lower wall of said lower die.

9. The pressing apparatus according to claim 8, wherein each of said cylindrical members further includes a slide cam engaging member extending outwardly therefrom which is engagable by said slide cam to cause said cylindrical members to rotate.

10. The pressing apparatus according to claim 9, further comprising a linkage mechanism for transmitting a return force from one of said cylindrical members to another of said cylindrical members located adjacent thereto.

11. The pressing apparatus according to claim 10, wherein said linkage mechanism includes a latching plate having a groove therein and attached to one of said cylindrical members, and a positioning pin attached to another of said cylindrical members located adjacent thereto, said pin being slidable within said groove.

12. The pressing apparatus according to claim 5, further comprising a linkage mechanism for transmitting a return force from one of said cylindrical members to another of said cylindrical members located adjacent thereto.

13. The pressing apparatus according to claim 12, wherein said linkage mechanism includes a latching plate having a groove therein and attached to one of said cylindrical members, and a positioning pin attached to another of said cylindrical members located adjacent thereto, said pin being slidable within said groove.

14. A pressing apparatus comprising:

an upper die and a lower die, said upper die and said lower die being movable relative to one another;

said lower die including a workpiece support, said lower die further including a plurality of cylindrical members rotatable with respect to said workpiece support, said cylindrical members including a central member rotatable about a first axis of rotation, and a pair of end members rotatable about a second axis of rotation spaced from and parallel to said first axis of rotation, said central member and said end members having an axially extending groove therein including first forming portions;

a return device for returning the cylindrical members to a position where the workpiece may be removed from the lower die, said return device comprising an air cylinder, said air cylinder including a rod having a distal portion pivotally attached to a connecting member extending from one of said cylindrical members through an opening provided in a lower wall of said lower die;

said upper die including a slide cam slidable thereon, said slide cam having second forming portions thereon at locations opposed to said first forming portions;

said cylindrical members further including a slide cam engaging member extending outwardly therefrom which is engagable by said slide cam to cause said cylindrical members to rotate, whereby displacement of said upper die toward said lower die causes said slide cam and said second forming portions to move toward said first forming portions of said central member and said end members to thereby shape a portion of a workpiece which is located between said first and second forming portions.

15. The pressing apparatus according to claim 14, further comprising a linkage mechanism for transmitting a return force from one of said cylindrical members to another of said cylindrical members located adjacent thereto.

16. The pressing apparatus according to claim 15, wherein said linkage mechanism includes a latching plate having a groove therein and attached to one of said cylindrical members, and a positioning pin attached to another of said cylindrical members located adjacent thereto, said pin being slidable within said groove.

17. The pressing apparatus according to claim 16, wherein said air cylinder is connected to said central member, and a pair of said linkage mechanisms transmit a return force from said central member to said end members located adjacent thereto.

* * * * *